US010132178B2

(12) United States Patent
Ishibashi et al.

(10) Patent No.: US 10,132,178 B2
(45) Date of Patent: Nov. 20, 2018

(54) STEAM TURBINE STATIONARY BLADE

(71) Applicant: Mitsubishi Hitachi Power Systems, Ltd., Nishi-ku, Yokohama (JP)

(72) Inventors: Koji Ishibashi, Yokohama (JP); Susumu Nakano, Yokohama (JP); Takeshi Kudo, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 338 days.

(21) Appl. No.: 14/968,272

(22) Filed: Dec. 14, 2015

(65) Prior Publication Data

US 2016/0169015 A1 Jun. 16, 2016

(30) Foreign Application Priority Data

Dec. 15, 2014 (JP) ..... 2014-253390

(51) Int. Cl.
*F01D 9/04* (2006.01)
*F01D 25/32* (2006.01)

(52) U.S. Cl.
CPC ..... *F01D 9/041* (2013.01); *F01D 25/32* (2013.01); *F05D 2220/31* (2013.01);
(Continued)

(58) Field of Classification Search
CPC ..... F01D 9/041; F01D 25/32; F05D 2230/60; F05D 2230/10; F05D 2240/123; F05D 2240/124; F05D 2220/31
See application file for complete search history.

(56) References Cited

U.S. PATENT DOCUMENTS 3,881,842 A * 5/1975 Kosyak ..... F01D 9/041 415/169.3
6,007,296 A * 12/1999 Ernst ..... F01D 25/32 411/349

(Continued)

FOREIGN PATENT DOCUMENTS

CN 103628929 A 3/2014
CN 203856516 U 10/2014

(Continued)

OTHER PUBLICATIONS

Extended European Search Report issued in counterpart European Application No. 15200088.1 dated Apr. 29, 2016 (8 pages).

(Continued)

*Primary Examiner* — Dwayne J White
*Assistant Examiner* — Adam W Brown
(74) *Attorney, Agent, or Firm* — Crowell & Moring LLP

(57) ABSTRACT

To provide a steam turbine stationary blade adapted to remove a liquid film effectively. A steam turbine stationary blade with a hollow region therein, the steam turbine stationary blade includes a plurality of slots and arranged in lines in a direction of a chord length, the plurality of slots communicate with a working fluid flow passageway and with the hollow region, and extends in a direction of a blade length, and at least one connecting portion disposed so that for each of the most downstream slot of the plurality of slots and, a surface directed toward the working fluid flow passageway is positioned closer to the hollow region than to a surface of the steam turbine stationary blade, and so that the connecting portion connects both sidewall surfaces of each of the most downstream slots, in the direction of the chord length.

10 Claims, 12 Drawing Sheets

(52) U.S. Cl.
CPC ..... *F05D 2230/10* (2013.01); *F05D 2230/60* (2013.01); *F05D 2240/123* (2013.01); *F05D 2240/124* (2013.01)

(56) References Cited

U.S. PATENT DOCUMENTS

| | | | | |
|---|---|---|---|---|
| 2010/0329853 | A1* | 12/2010 | Guo | F01D 9/065 415/169.2 |
| 2014/0030065 | A1* | 1/2014 | Nakano | F01D 5/28 415/115 |
| 2014/0079556 | A1* | 3/2014 | Ishibashi | F01D 5/145 416/223 A |
| 2016/0169051 | A1* | 6/2016 | Takata | F01D 25/32 415/115 |
| 2016/0369633 | A1* | 12/2016 | Chan | F01D 5/143 |

FOREIGN PATENT DOCUMENTS

| | | | | |
|---|---|---|---|---|
| EP | 2 282 013 | A2 | 2/2011 | |
| JP | 49-9522 | B1 | 3/1974 | |
| JP | 63-272902 | A | 10/1988 | |
| JP | 4-255503 | A | 9/1992 | |
| JP | 11-210404 | A | 8/1999 | |
| JP | 2014-25443 | A | 2/2014 | |
| JP | 2014-55577 | A | 3/2014 | |
| JP | WO 2015015859 | A1 * | 2/2015 | F01D 25/32 |
| WO | WO 2015/015859 | A1 | 2/2015 | |

OTHER PUBLICATIONS

Chinese-language Office Action issued in counterpart Chinese Application No. 201510917663.4 dated Oct. 21, 2016 (fifteen (15) pages).
Japanese-language Office Action issued in counterpart Japanese Application No. 2014-253390 dated Apr. 24, 2018 (six (6) pages).

* cited by examiner

PRIOR ART

PRIOR ART

PRIOR ART

STEAM TURBINE STATIONARY BLADE

BACKGROUND OF THE INVENTION

1. Field of the Invention

The present invention relates to steam turbine stationary blades.

2. Description of the Related Art

In the last stages of low pressure turbines and in one or two stages previous to the last stages, since pressure is typically very low, working fluid (steam) is in a state of the wet steam containing liquefied microscopic droplets of water. The water droplets contained in the working fluid stick to a surface of a stationary blade and combine with other water droplets to form a liquid film (drain) on the blade surface. After being withdrawn from the blade surface by the working fluid, the liquid film along with the working fluid flows down the flow passageway in a form of coarse droplets much larger than droplets of water. The coarse droplets, although more or less fine-grained by the working medium, continue to maintain a certain size and flow downward. Inertial force of the coarse droplets, however, does not allow them to change their direction of flow along the flow passageway as suddenly as the working fluid can. For this reason, the coarse droplets are likely to rapidly collide against a moving blade present downstream in the flow direction of the coarse droplets, thus to cause erosion of the moving blade surface or to impede rotation of the moving blade, and to result in moisture loss.

To reduce erosion, generally it is most effective to remove the liquid film formed on the surface of the stationary blade. In contrast, JP-2014-25443-A, for example, proposes providing a slot in a trailing edge (tail side) of a stationary blade and drawing a liquid film into a hollow region of the blade via the slot.

SUMMARY OF THE INVENTION

The stationary blade in JP-2014-25443-A has a tail side with a pressure side plate of the airfoil, mounted on a suction side plate of the airfoil so that the two plates face each other via an airgap, and this airgap serves to form a slot between the pressure side plate of the airfoil and the suction side plate of the airfoil, on the pressure side of the airfoil. This construction often causes a stepped region to occur between the pressure side plate and suction side plate of the airfoil, across the slot on the pressure side of the airfoil. In this case, part of the liquid film is likely to leave the blade surface and causes erosion at the stepped region.

The present invention has been made with the above in mind, and an object of the invention is to provide a steam turbine stationary blade adapted to effectively remove a liquid film.

In an aspect of the present invention, a steam turbine stationary blade with a hollow region in it includes: a plurality of slots arranged in lines in a direction of a chord length, the slots each communicating with a working fluid flow passageway and with the hollow region and extending in a direction of the blade length; and at least one connecting portion disposed so that for each of the most downstream slot of the plurality of slots, a surface directed toward the working fluid flow passageway is positioned closer to the hollow region than to a surface of the blade, and so that the connecting portion connects both sidewall surfaces of each of the most downstream slot, in the direction of the chord length.

In accordance with the present invention, the steam turbine stationary blade adapted to effectively remove a liquid film from the blade surface can be provided.

DESCRIPTION OF EMBODIMENTS

First Embodiment

Configuration

Figure 1:
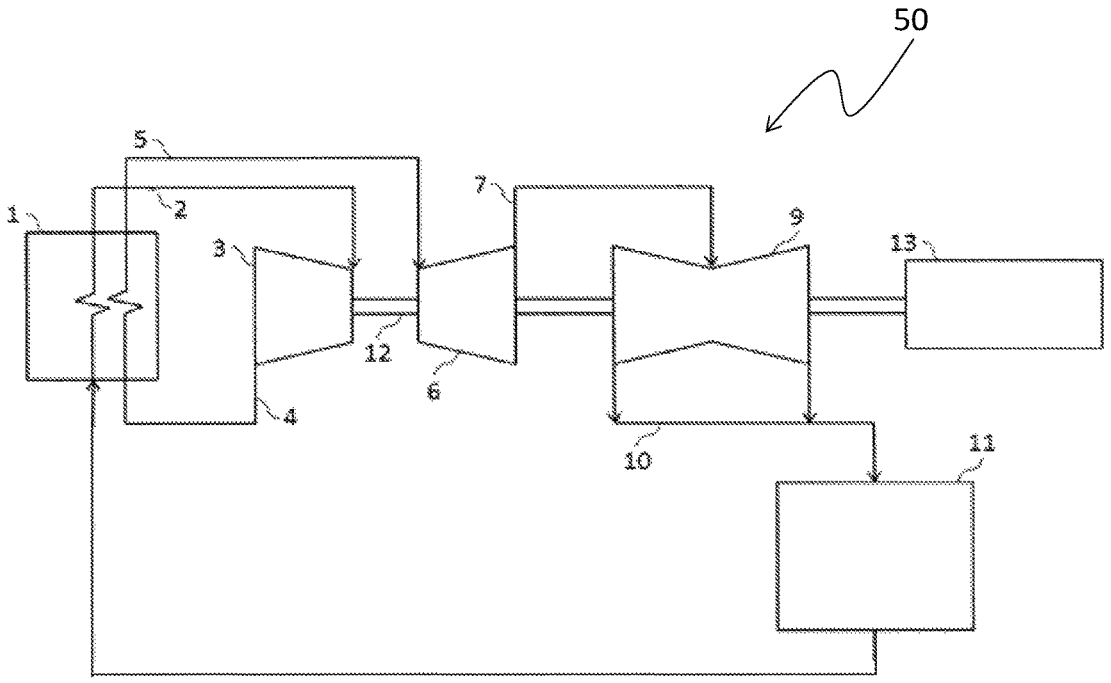
FIG. 1 is a schematic diagram showing an exemplary overall configuration of steam turbine equipment applying a steam turbine stationary blade according to a first embodiment of the present invention.

FIG. 1 is a schematic diagram showing an exemplary overall configuration of steam turbine equipment applying a steam turbine stationary blade according to a present embodiment.

The steam turbine equipment 50 shown in FIG. 1 includes a boiler 1, a high pressure turbine 3, an intermediate pressure turbine 6, a low pressure turbine 9, and a condenser 11.

The boiler 1 is a boiler fired by a fossil fuel, and is an example of a steam generator. The boiler 1 fires the fossil fuel, then heats a condensate supplied from the condenser 11, and generates high temperature high pressure steam. The steam that the boiler 1 has generated is guided into the high pressure turbine 3 via a main steam line 2 and drives the high pressure turbine 3. The steam that has driven the high pressure turbine 3 and been reduced in pressure flows down a high pressure turbine exhaust line 4 and after being guided into the boiler 1, is heated again to become reheated steam.

The reheated steam heated in the boiler 1 is guided into the intermediate pressure turbine 6 via a hot reheated steam line 5 and drives the intermediate pressure turbine 6. The steam that has driven the intermediate pressure turbine 6 and been reduced in pressure is guided into the low pressure turbine 9 via an intermediate pressure turbine exhaust line 7 and drives the low pressure turbine 9. The steam that has driven the low pressure turbine 9 and been reduced in pressure is guided into the condenser 11 directly below the low pressure turbine via a low pressure turbine exhaust chamber 10. The condenser 11, which includes a cooling water line (not shown), performs a heat exchange between the steam that has been guided into the condenser 11, and cooling water that flows through the cooling water line, and thereby condenses the steam. The condensate that has been obtained by the condensation in the condenser 11 is supplied to the boiler 1 once again.

The high pressure turbine 3, the intermediate pressure turbine 6, and the low pressure turbine 9 are coupled coaxially. In addition, a turbine rotor 12 has an electrical generator 13 coupled thereto, the generator 13 is driven by rotative power of the high pressure turbine 3, intermediate pressure turbine 6, and low pressure turbine 9, and outputs from the high pressure turbine 3, intermediate pressure turbine 6, and low pressure turbine 9, are retrieved as electric power.

The high pressure turbine 3, the intermediate pressure turbine 6, and the low pressure turbine 9 are each an axial-flow turbine equipped with a plurality of turbine stages each including stationary blades and steam turbine moving blades (moving blades) provided downstream in a flow direction of a working fluid with respect to the stationary blades. The turbine stages, disposed on the turbine rotor 12, are arranged axially on the turbine rotor 12.

Figure 2:
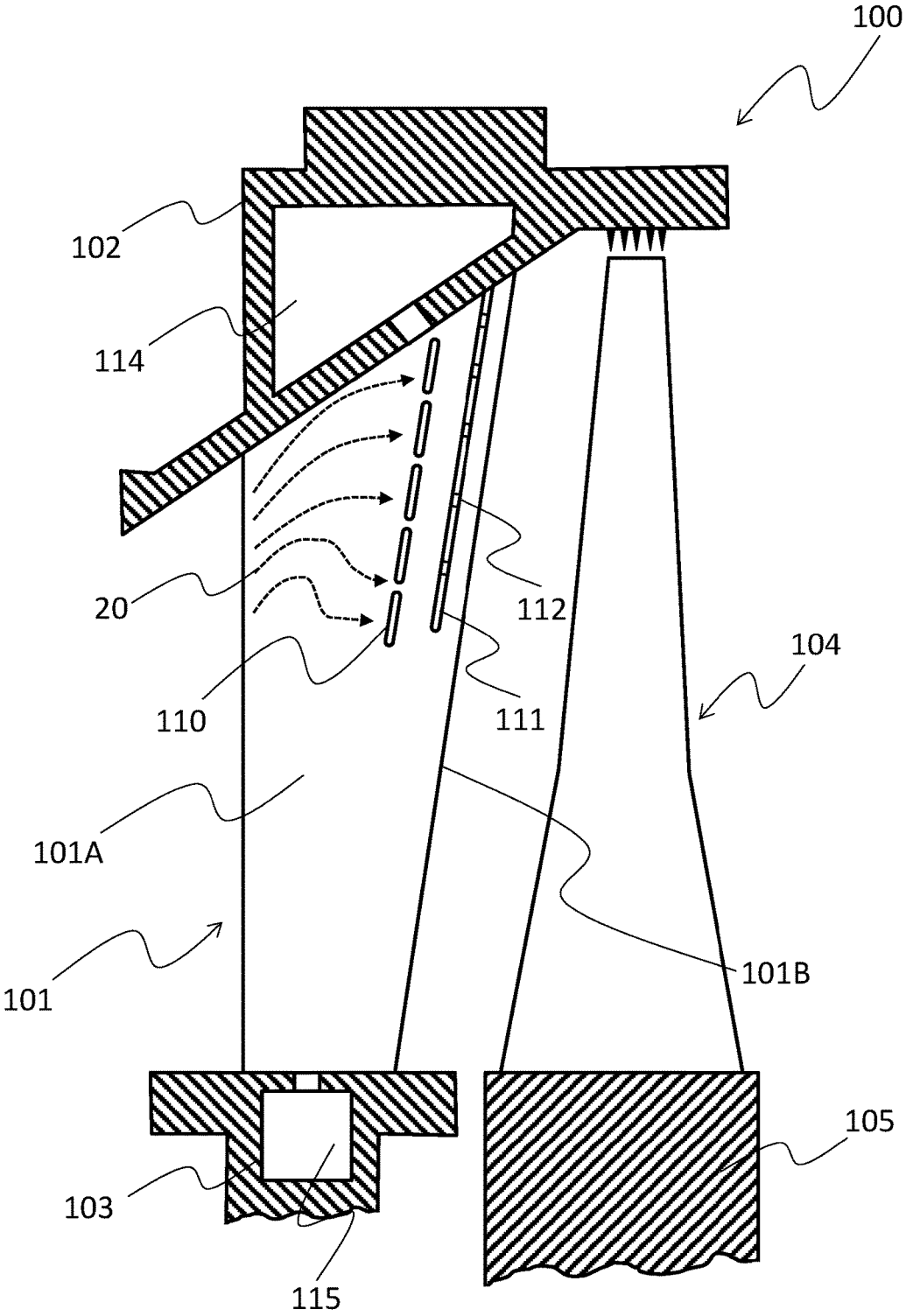
FIG. 2 is a schematic diagram showing an exemplary configuration of a last stage including the stationary blade according to the first embodiment of the present invention.
Figure 3:
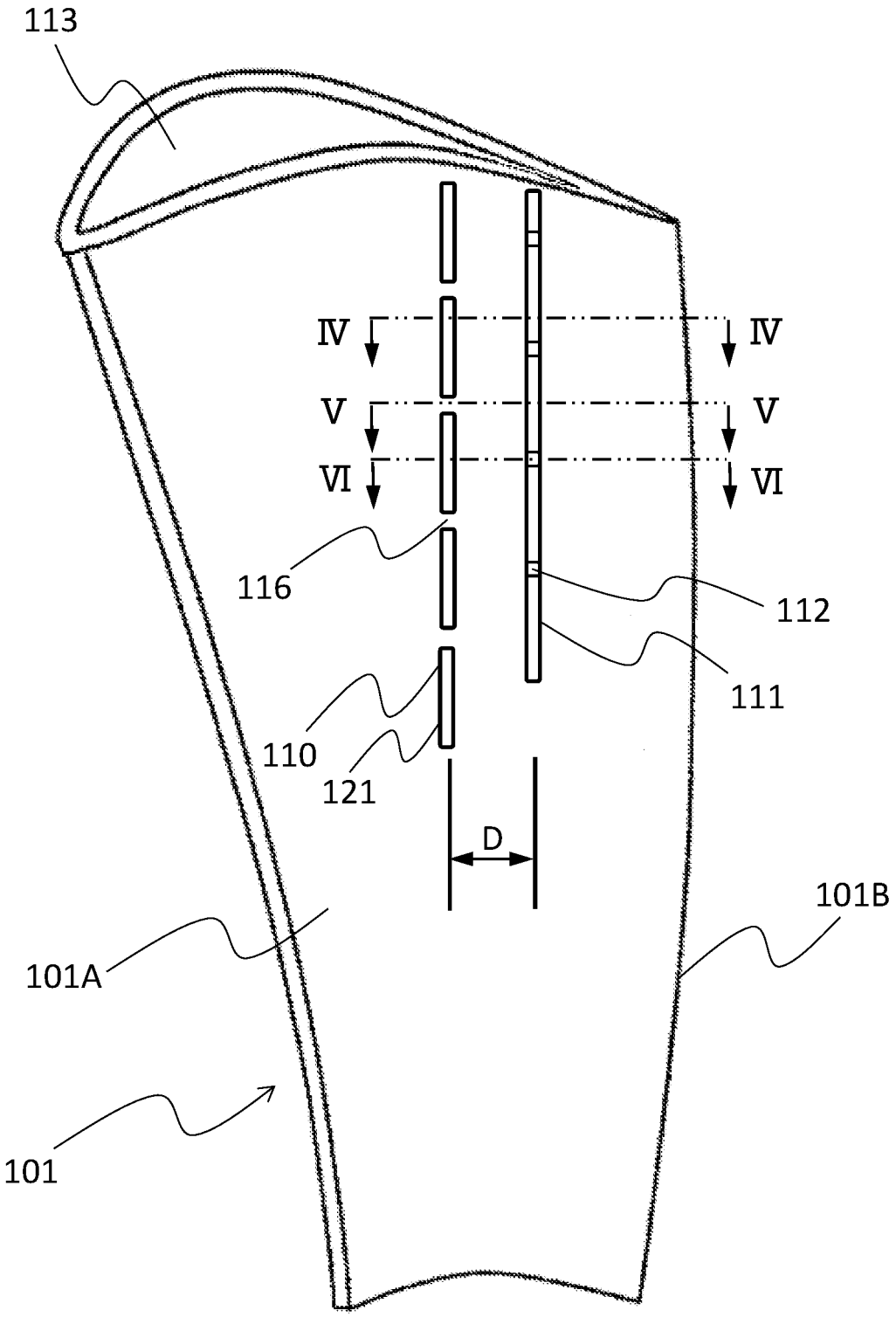
FIG. 3 is a perspective view of the stationary blade shown in FIG.

FIG. 2 is a schematic diagram showing an exemplary configuration of a last stage including a stationary blade according to the present embodiment, and FIG. 3 is a perspective view of the stationary blade shown in FIG. 2. An example in which the stationary blade according to the present embodiment is provided in a last stage of the low pressure turbine 9 will be described below, and the description also applies to disposing the stationary blade in any other turbine stage of the low pressure turbine 9, in a turbine stage of the high pressure turbine 3, in a turbine stage of the intermediate pressure turbine 6, or in other turbine stages present under an environment having wet steam as the working fluid. In the following description, an upstream side and downstream side of a flow direction of the working fluid which flows through the last stage will, be referred to simply as the upstream side and the downstream side, respectively.

As shown in FIG. 2, the last stage 100 includes stationary blades 101, a diaphragm outer race 102, a diaphragm inner race 103, moving blades 104, and a disk 105.

The diaphragm inner race 103 is an annular member provided in a circumferential direction of the turbine rotor 12, at a radial inner edge of the low pressure turbine 3. The diaphragm inner race 103 includes a hollow region 115 inside it. The diaphragm outer race 102 is an annular member provided in the circumferential direction of the turbine rotor 12, at a radial outer edge of the low pressure turbine 9. The diaphragm outer race 102 likewise includes a hollow region 114 inside it. The hollow region 114 of the diaphragm outer race 102 communicates with an exhaust chamber (not shown) via a communicating line (not shown, either). Between the diaphragm outer race 102 and the diaphragm inner race 103, a plurality of stationary blades 101 are fixedly disposed in the circumferential direction of the turbine rotor 12. A plurality of moving blades 104 are mounted in the circumferential direction of the turbine rotor 12, at an outer circumferential region of the disk 105. As with other stages, the last stage 100 has an upstream side exposed to a pressure higher than at a downstream side of the last stage.

As shown in FIG. 3, the stationary blade 101 is formed from a metallic plate plastically deformed by bending or the like. The stationary blade 101 internally has a hollow region 113. The hollow region 113 communicates with the hollow region 114 of the diaphragm outer race 102 and the hollow region 115 of the diaphragm inner race 103. Since the hollow region 114 of the diaphragm outer race 102 communicates with the exhaust chamber, an internal pressure of the hollow region 113 of the stationary blade 101 is lower than an internal pressure of the working fluid flow passageway (i.e., an external pressure of the stationary blade 101).

On the pressure side of airfoil 101A of the stationary blade 101, slot 110 as upstream slot, and slot 111 as the most downstream slot, are arranged in rows next to each other with a clearance of D in the direction of the chord length. While FIGS. 2 and 3 show the stationary blade 101 with the upstream slot 110 and the most downstream slot 111 arranged on the blade, three slot rows or more in all may be provided on the stationary blade 101 by adding a third slot row upstream with respect to the most downstream slot 111.

Of all slots formed on the stationary blade 101, the most downstream slot 111 exists at the most downstream side of the stationary blade 101, in the direction of the chord length. The most downstream slot 111 is continuously formed on the pressure side of airfoil 101A of the stationary blade 101 so as to extend in the direction of the blade length of the stationary blade 101, and they serve to establish communication between the working fluid flow passageway and the hollow region 113. The continuous formation on the pressure side of airfoil 101A refers to formation without a clearance on the pressure side of airfoil 101R. At least one connecting portion 112 is disposed between the most downstream slot 111. The connecting portion 112 will be described later herein.

The upstream slot 110 is disposed upstream in the direction of the chord length of the stationary blade 101 relative to the most downstream slot 111. The upstream slot 110 is formed to extend in the direction of the blade length of the stationary blade 101, and serves to establish communication between the working fluid flow passageway and the hollow region 113. The upstream slot 110 includes a plurality of (in FIG. 3, five) slots 121 that are provided rectilinearly at predetermined intervals in the direction of the blade length of the stationary blade 101, on the pressure side of airfoil 101A. Discontinuous portions 116 each flush with the pressure side of airfoil 101R are formed between adjacent upstream slots 110 in the direction of the blade length of the stationary blade 101. The connecting portion 112 is shifted in position in the direction of the blade length of the stationary blade 101 relative to the discontinuous portions 116.

As described above, the internal pressure of the hollow region 113 is lower than that of the working fluid flow passageway. In the upstream slot 110 and the most downstream slot 111, therefore, a pressure at a region close to the working fluid flow passageway is higher than a pressure at a region close to the hollow region 113. That is to say, in the upstream slot 110 and the most downstream slot 111, there is a difference in pressure between an inlet side (working fluid flow passageway side) and an outlet side (hollow region 113 side).

Although the upstream slot 110 and the most downstream slot 111 are formed rectilinearly in FIGS. 2 and 3, they may be formed to have a curved shape fitting a shape of a trailing edge 101B of the stationary blade 101. In addition, although each upstream slot 110 and each of the most downstream slot 111 are disposed only in a region extending from a midway region in the direction of the blade length of the stationary blade 101, to a region close to the outer race 102 of the stationary blade 101, at least one of the upstream slot 110 and the most downstream slot 111 may be disposed in an entire region from the diaphragm outer race 102 to the diaphragm inner race 103 (i.e., over the entire length in the direction of the blade length of the stationary blade 101).

The following details the upstream slot 110 and the most downstream slot 111. While the following description relates to a case in which the liquid film 20 formed on the pressure side of airfoil 101A of the stationary blade 101 is removed via the upstream slot 110 and the most downstream slot 111, the same also applies even if the upstream slot 110 and the most downstream slot 111 are disposed on a suction side of airfoil and a liquid film formed on the suction side of airfoil is removed.

Actions of the Upstream Slot 110 and the Most Downstream Slot 111

When the working fluid that flows down the last stage 100 is wet steam, water droplets contained in the working fluid will stick to the pressure side of airfoil 101A of the stationary blade 101. The droplets sticking to the pressure side of airfoil 101A will unite with other water droplets, thereby forming a liquid film 20 on the pressure side of airfoil 101A, as shown in FIG. 2. FIG. 2 shows, of all the liquid film formed on the pressure side of airfoil 101A, only sections of the liquid film that are formed near the diaphragm outer race 102, and presence of these sections can be a direct cause of erosion of the moving blades. The liquid film 20 flows in a direction of a resultant force between pressure and shear force, at an interface with the working fluid, and is directed along the pressure side of airfoil 101A, toward the trailing edge 101B of the stationary blade 101.

Figure 4:
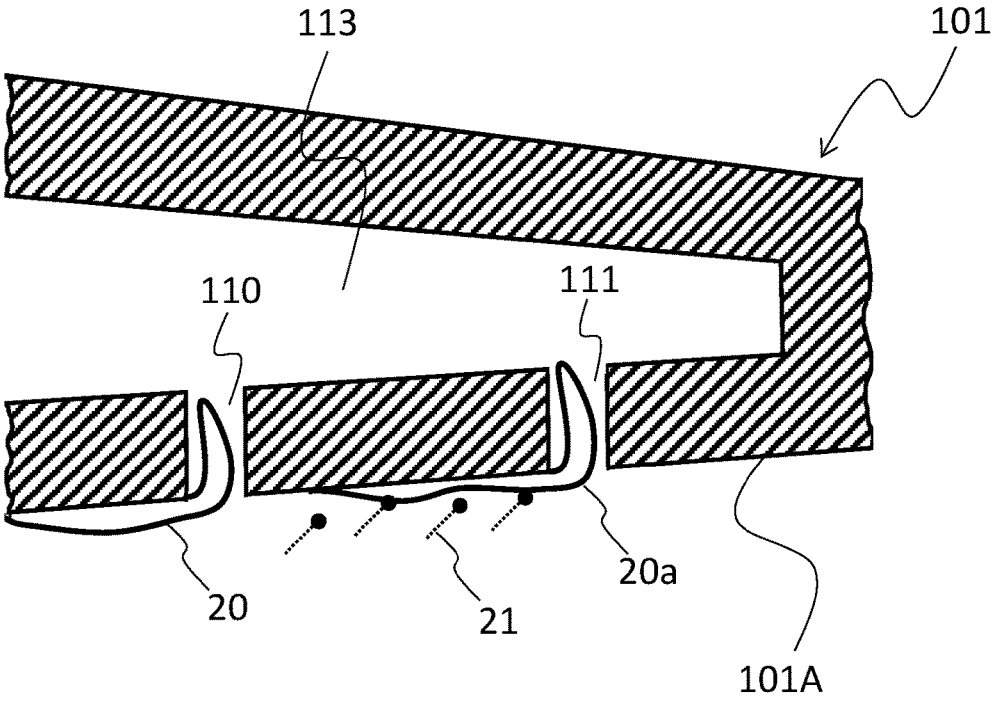
FIG. 4 is a sectional view of the stationary blade as viewed from a direction of arrows assigned to a IV-IV line in FIG. 3.
Figure 5:
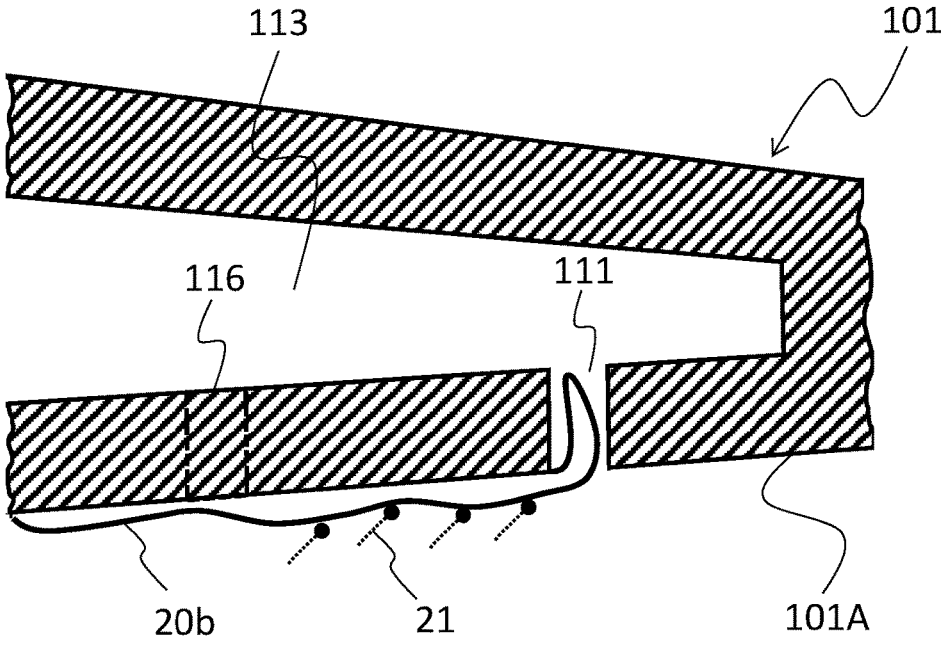
FIG. 5 is a sectional view of the stationary blade as viewed from a direction of arrows assigned to a V-V line in FIG. 3.
Figure 6:
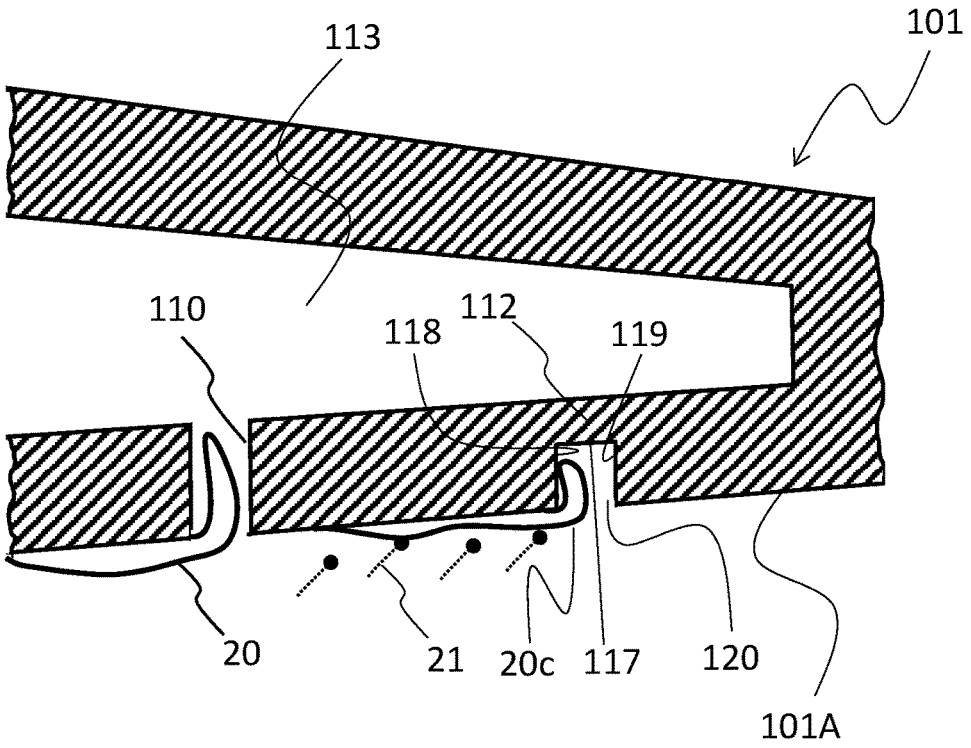
FIG. 6 is a sectional view of the stationary blade as viewed from a direction of arrows assigned to a VI-VI line in FIG. 3.

FIG. 4 is a sectional view of the stationary blade as viewed from a direction of arrows assigned to a IV-IV line in FIG. 3, FIG. 5 is a sectional view of the stationary blade as viewed from a direction of arrows assigned to a V-V line in FIG. 3, and FIG. 6 is a sectional view of the stationary blade as viewed from a direction of arrows assigned to a VI-VI line in FIG. 3.

As shown in FIG. 4, a section as viewed from the direction of the arrows assigned to the IV-IV line includes part of the upstream slot 110 and part of the most downstream slot 111. At the section shown in FIG. 4, since the upstream slot 110 communicates with the working fluid flow passageway and the hollow region 113, the liquid film 20 formed on the pressure side of airfoil 101A of the stationary blade 101 is drawn into the hollow region 113 from the pressure side of airfoil 101A via the upstream slot 110. In addition, since the most downstream slot 111 communicates with the working fluid flow passageway and the hollow region 113, a liquid film 20*a* newly formed by a water droplet 21 sticking to the pressure side of airfoil 101A, at a downstream side of the upstream slot 110, is drawn into the hollow region 113 from the pressure side of airfoil 101A via the most downstream slot 111. The liquid film 20 that has been drawn into the hollow region 113 is supplied to the hollow region 114 of the diaphragm outer race 102 and the like, and then further supplied to the exhaust chamber and the like via the communicating line.

As shown in FIG. 5, a section as viewed from the direction of the arrows assigned to the V-V line includes part of the discontinuous portions 116 between upstream slot 110 and part of the most downstream slot 111. At the section shown in FIG. 5, a liquid film 20*b* formed on the pressure side of airfoil 101A of the stationary blade 101 flows through the discontinuous portion 116 between the upstream slot 110 and then flows downstream along the pressure side of airfoil 101A while incorporating a water droplet 21 sticking to the pressure side of airfoil 101A, at the downstream side of the upstream slot 110. At the section shown in FIG. 5, however, since the most downstream slot 111 communicates with the working fluid flow passageway and the hollow region 113, the liquid film 20*b* is drawn into the hollow region 113 from the pressure side of airfoil 101A of the airfoil via the most downstream slot 111 and then supplied to the exhaust chamber and the like.

As shown in FIG. 6, a section as viewed from the direction of the arrows assigned to the VI-VI line includes part of the connecting portions 112 between upstream slot 110 and the most downstream slot 111.

The connecting portion 112 is disposed inside the most downstream slot 111 so that a surface 117 directed toward the working fluid flow passageway is positioned closer to the hollow region 113 than to the pressure side of airfoil 101A, with respect to the most downstream slot 111. In other words, at the VI-VI line, the dent 120 which is indented toward the hollow region 113 from the pressure side of airfoil 101A, and whose bottom forms the surface 117 directed toward the working fluid flow passageway is formed on the pressure side of the airfoil 101A so as to appropriately fit the most downstream slot 111. The connecting portion 112 connects both wall surfaces, that is, inner surfaces 118 and 119, of the most downstream slot 111, in the direction of the chord length. Both ends of the connecting portion 112 in the direction of the blade length communicate with the hollow region 113 via the most downstream slot 111. The connecting portion 112 is formed integrally with, for example, the pressure side of the airfoil 101A or formed by machining the pressure side of the airfoil 101A.

While a depth of the connecting portion 112 from the pressure side of the airfoil 101A to the surface 117 directed toward the working fluid flow passageway and a width of the connecting portion. 112 in the direction of the blade length are not limited to any particular ones, depth of the dent 120 is preferably as great as possible and the width of the connecting portion 112 are preferably as narrow as possible. For example, the depth is preferably at least ½ of plate thickness of the pressure side of the airfoil 101A, and the width is preferably 10 mm or less.

At a section shown in FIG. 6, since the upstream slot 110 communicates with the working fluid flow passageway and the hollow region 113, the liquid film 20 formed on the pressure side of airfoil 101A of the stationary blade 101 is drawn into the hollow region 113 from the pressure side of airfoil 101A via the upstream slot 110 and then supplied to the exhaust chamber and the like.

Meanwhile, at the section shown in FIG. 6, since the connecting portion 112 is disposed so that the surface 117 directed toward the working fluid flow passageway is positioned closer to the hollow region 113 than to the pressure side of the airfoil 101A, a liquid film 20*c* formed by a water droplet. 21 sticking to the pressure side of airfoil 101A, at the downstream side of the upstream slot 110, flows into the dent 120 and then flows in the direction of the blade length along the surface 117 directed toward the working fluid flow passageway. The liquid film 20*c* is next drawn into the hollow region 113 via the most downstream slot 111 and supplied to the exhaust chamber and the like. That is, the liquid film 20*c* is captured by the dent 120, thereby a suction action is acted to the liquid film 20*c* which is captured.

Positions of the Upstream Slot 110 and the Most Downstream Slot 111

Figure 7:
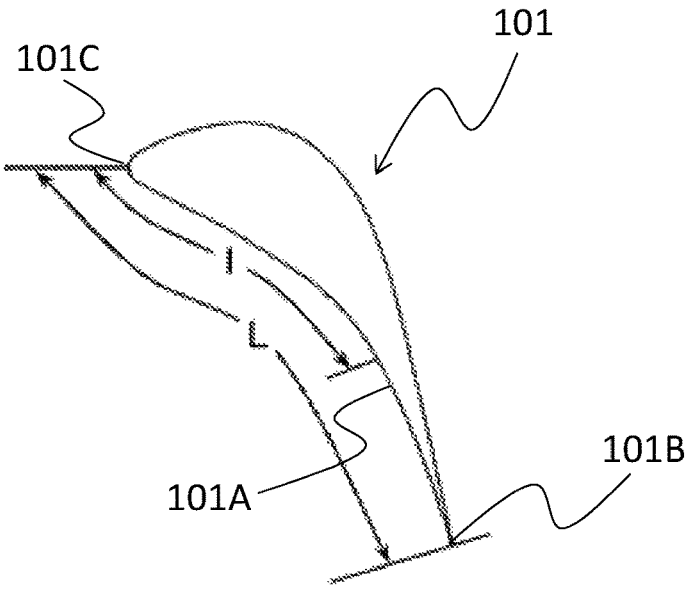
FIG. 7 is a top view of the stationary blade according to the first embodiment of the present invention.
Figure 8:
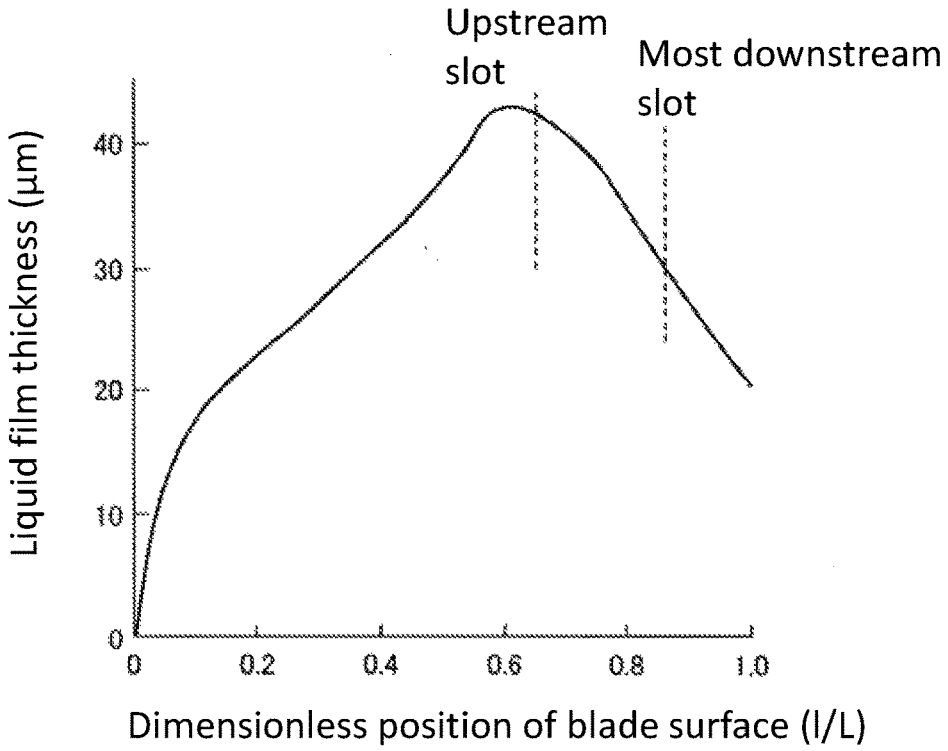
FIG. 8 is a diagram that shows exemplary thickness of a liquid film. (an exemplary amount of liquid film) formed on a pressure side of airfoil of the stationary blade according to the first embodiment of the present invention.

FIG. 7 is a top view of the stationary blade 101 according to the present embodiment, and FIG. 8 is a diagram that shows exemplary thickness of a liquid film (an exemplary amount of liquid film) formed on the pressure side of airfoil 101A of the stationary blade 101 according to the present embodiment. A horizontal axis in FIG. 8 denotes a dimensionless position of the blade surface and a vertical axis denotes the liquid film thickness. The dimensionless position of the blade surface refers to a dimensionless value (l/L) that is obtained by dividing a distance as measured from the leading edge 1010 of the stationary blade 101 to a given position of the pressure surface of airfoil 101A, along the pressure surface of airfoil 101A, by a distance as measured from the leading edge 1010 of the stationary blade 101 to the trailing edge 101B, along the pressure surface of the airfoil 101A (see FIG. 7 for further details of l/L).

In general, thickness of a liquid film on a line from a leading edge of a stationary blade to a trailing edge of the blade, along the pressure surface of the airfoil differs according to a particular position of pressure side of the airfoil. On the pressure side of the airfoil, there is a peak position at which an increase in velocity of a working fluid relative to the pressure side of the airfoil increases moisture accumulated on the pressure side of the airfoil and maximizes the thickness of the liquid film. For this reason, a slightly downstream side of the peak position of the liquid film thickness is preferably slot for efficient removal of the liquid film formed on the pressure side of the airfoil.

In an example of FIG. 8, the thickness of the liquid film formed on the pressure side 101A of the stationary blade of airfoil 101 is at the maximum in a neighborhood of a position at which the dimensionless value l/L equals 0.6. At a downstream side relative to the position where the liquid film thickness becomes the maximum, the liquid film thickness decreases with increasing velocity of the working fluid relative to the pressure side of the airfoil 101A.

In the present embodiment, therefore, as indicated by a dashed line in FIG. 8, the upstream slot 110 is disposed within a 0.6 to 0.8 range of the dimensionless value in that corresponds to a slightly downstream side of a region in which the liquid film thickness becomes the maximum.

However, even if a liquid film that is formed upstream of the upstream slot 110 is 100% removed via the upstream slot 110, water droplets may stick to the pressure side of airfoil 101A of the stationary blade 101 and another liquid film may be formed on the pressure side of airfoil 101A.

Accordingly in the present embodiment, the most downstream slot 111 is disposed at a position that is as close as possible to a dimensionless value of l/L=1.0 and where the dimensional value l/L is greater than that of the upstream slot 110, that is, at a position closer to the trailing edge 1019 of the stationary blade 101, thereby to remove as much as possible of the liquid film formed on the pressure side of airfoil 101A.

First Comparative Example

Figure 9:
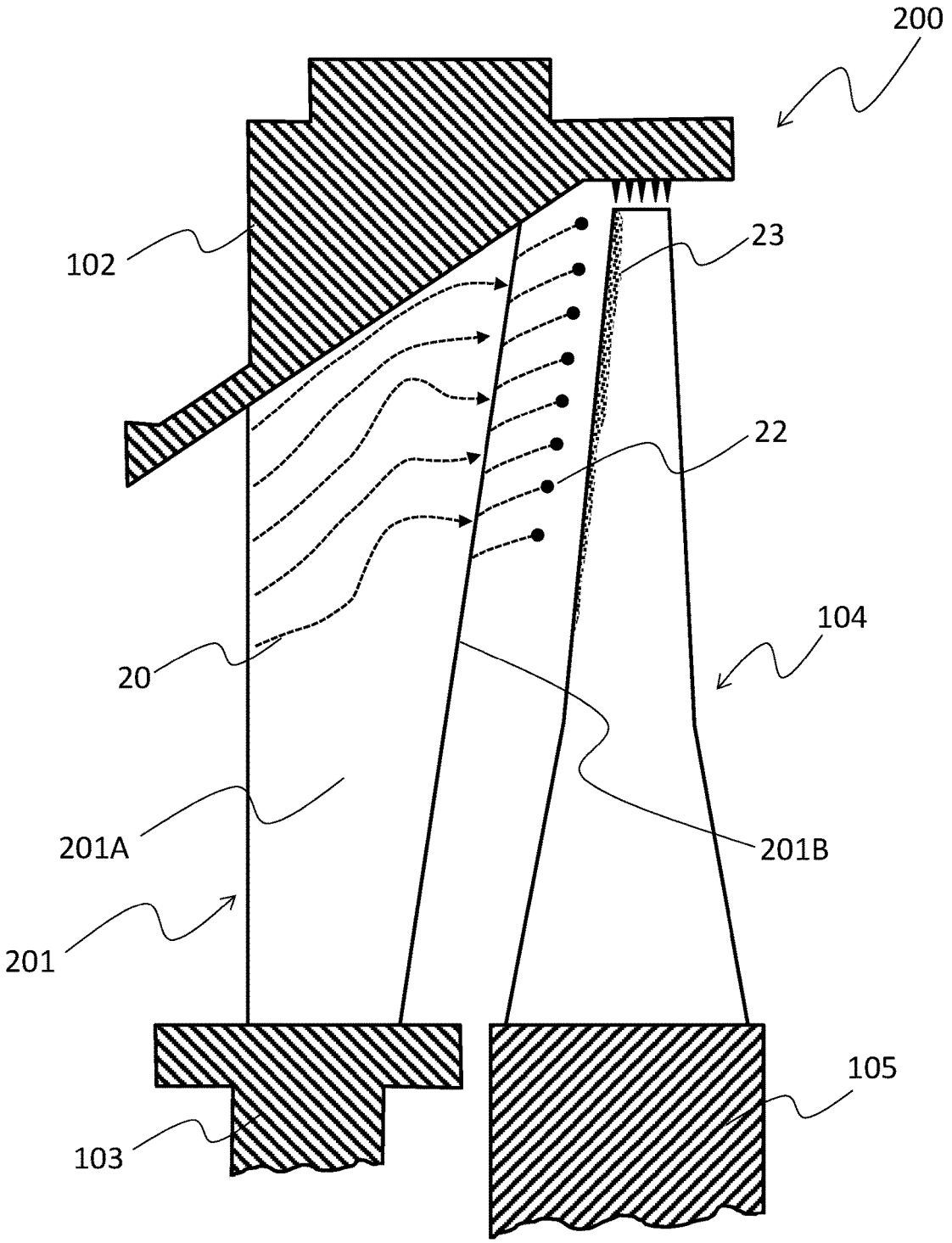
FIG. 9 is a schematic diagram showing an exemplary configuration of a last stage in a first comparative example.

FIG. 9 is a schematic diagram showing an exemplary configuration of a last stage in a first comparative example. In FIG. 9, elements equivalent to those of the last stage 100 in FIG. 2 are each assigned the same reference number, and description of these elements is omitted as appropriate.

As shown in FIG. 9, a stationary blade 201 in the first comparative example includes no slots. In this case, when a working fluid that flows down the last stage 200 is wet steam, a liquid film 20 formed on a pressure side of airfoil 201A of a stationary blade 201 by water droplets contained in the working fluid will flow down the pressure side of airfoil 201A, toward a trailing edge 2019 of the stationary blade 201. And then when the liquid film 20 reaches the trailing edge 2019, the working fluid will cause the liquid film to leave the pressure side of airfoil 201A, disperse toward a downstream side in a state of water drops 22, and collide against a moving blade 104. This will result in erosion 23 of the moving blade 104. In addition, the collisions of the water droplets 22 against the moving blade 104 will obstruct rotation of the moving blade 104 and could even cause a moisture loss.

Second Comparative Example

Figure 10:
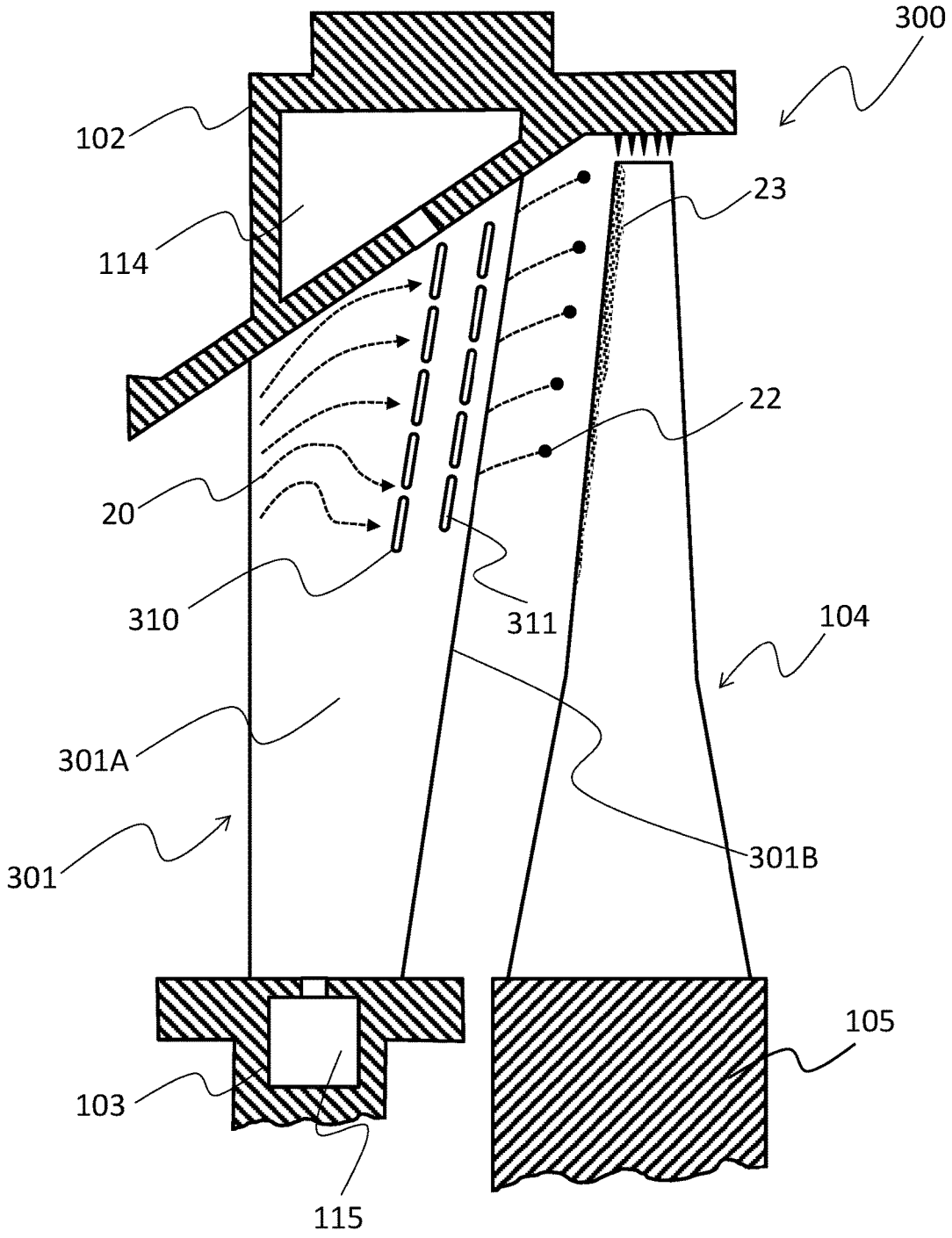
FIG. 10 is a schematic diagram showing an exemplary configuration of a last stage in a second comparative example.
Figure 11:
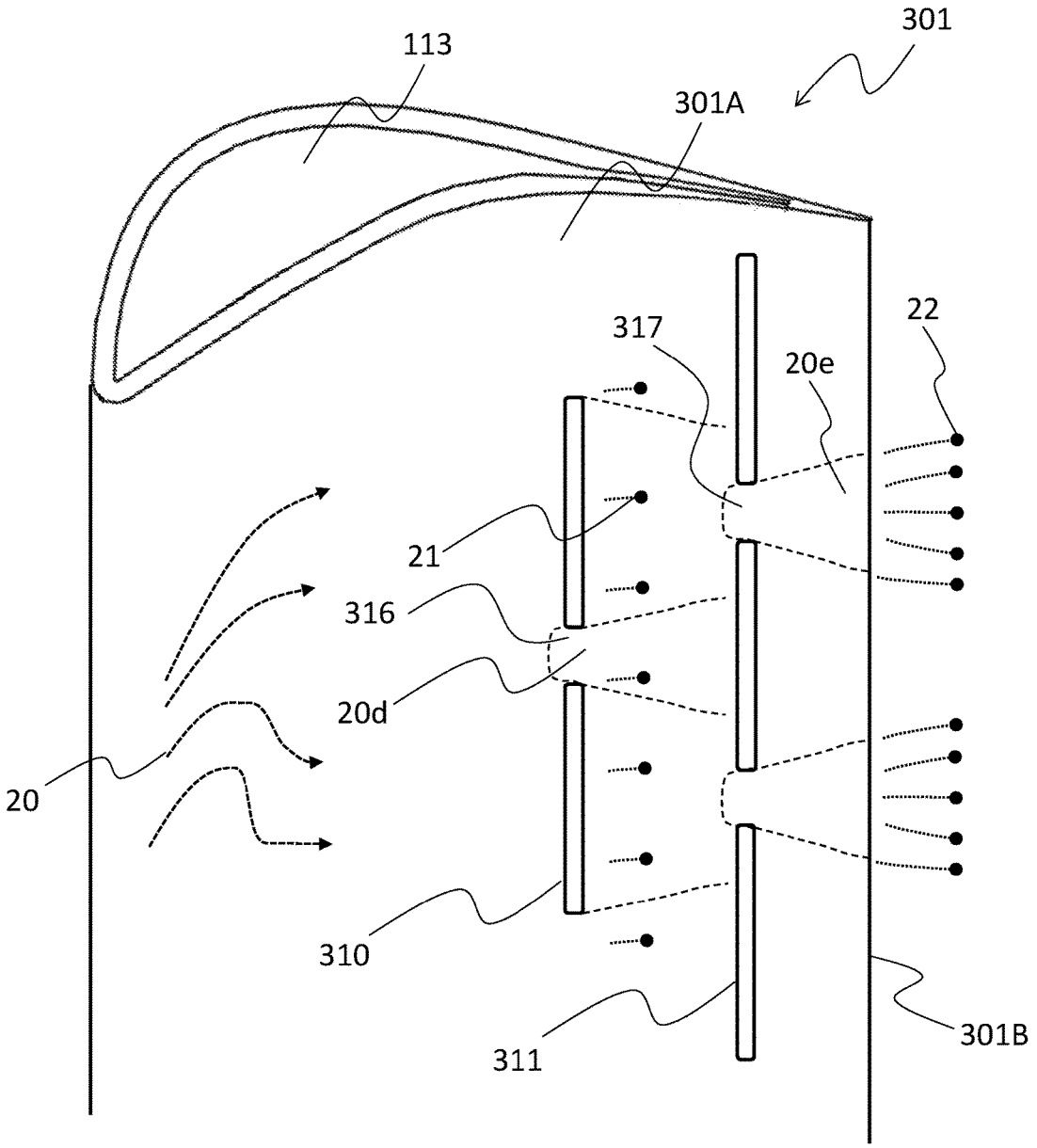
FIG. 11 is a partly enlarged perspective view of a stationary blade shown in FIG. 10.

FIG. 10 is a schematic diagram showing an exemplary configuration of a last stage in a second comparative example, and FIG. 11 is a partly enlarged perspective view of a stationary blade shown in FIG. 10. In FIGS. 10 and 11, elements equivalent to those of the last stage 100 in FIG. 2 are each assigned the same reference number, and description of these elements is omitted as appropriate.

As shown in FIG. 10, a stationary blade 301 in the last stage 300 includes upstream slots 310 and downstream slots 311. As shown in FIG. 11, the upstream slots 310 and the downstream slots 311 are of configurations equivalent to those of the upstream slot 110. In this case, part of a liquid film 20*d* formed on a pressure side of airfoil 301A through a discontinuous portion 316 of the upstream slots 310, and part of a liquid film newly formed downstream of the upstream slots 310 are likely to form a liquid film 20*e* downstream of the downstream slots 311 through discontinuous portions 317 thereof. The liquid film 20*e* could cause erosion 23 (see FIG. 10) of the moving blade 104 and a moisture loss.

Effects (1) As described in FIG. 11, disposing a discontinuous portion between slots to raise their strength causes the liquid film 20*e* to be formed downstream of the downstream slots 311 even if the number of slots is two. Therefore, slots are preferably arranged continuously in the direction of the blade length, at least at a downstream side (trailing edge side) of the stationary blade, in the direction of its chord length, as far as possible for structural reasons on the stationary blade.

If a stepped portion occurs across a slot, however, part of the liquid film is likely to leave the pressure side of airfoil, at the stepped portion, and thus could cause the erosion of the moving blade. Slots, therefore, need to be provided accurately to remove efficiently the liquid film formed on the pressure side of airfoil.

In the present embodiment, the connecting portions 112 between the most downstream slot 111 each have the surface 117 directed toward the working medium flow passageway and positioned closer to the hollow region 113 than to the pressure side of the airfoil 101A, and thus each of the connecting portions 112, unlike the discontinuous portion(s) described in FIG. 11, allows the liquid film to be captured by the dent. 120 being present at a bottom portion of the connecting portion 112. In addition, the wall surfaces of each of the most downstream slot 111, at the upstream and downstream sides thereof, are connected at appropriate intervals by the connecting portion. 112, so that occurrence of a stepped portion, on the pressure side of the airfoil 101A, across the most downstream slot 111, can be suppressed. This in turn suppresses the withdrawal of the liquid film formed on the pressure side of the airfoil 101A, thus allowing effective removal of the liquid film and hence the dispersing of the water droplets toward the downstream side of the stationary blade 101. This also suppresses the erosion of the moving blade, allows the suppression of a moisture loss on the moving blade 104, and hence allows reliability of the steam turbine to be enhanced.

(2) In the present embodiment, since the inner surfaces 118 and 119 of the most downstream slot 111 that face each other in the direction of the chord length are connected by the connecting portion 112, strength of the stationary blade 101 can be improved that will be obtained if the most downstream slot is configured to communicate with a hollow region over the entire length of the direction of the blade length. Additionally, since deformation of the most downstream slot 111 can be suppressed, accuracy of the most downstream slot 111 can be managed easily.

(3) As described in FIG. 8, the liquid film thickness differs according to the particular position of the pressure side of the airfoil. In the present embodiment, therefore, the upstream slot 110 is disposed slightly downstream relative to the peak position of the liquid film thickness, and the most downstream slot 111 is disposed downstream of the upstream slot 110, the most downstream slot 111 being positioned close to the trailing edge 101B of the stationary blade 101. This enables substantially complete removal or a thick liquid film through the upstream slot 110, also enables final removal of the liquid film formed downstream of the upstream slot 110, and efficient removal of the liquid film formed on the pressure side of the airfoil 101A.

(4) The stationary blade 101 according to the present embodiment includes the plurality of slots arranged in the direction of the chord length so as to communicate with the working fluid flow passageway and the hollow region 113 and so as to extend in the direction of the blade length, and also includes the connecting portions 112 each connecting both inner walls 118 and 119 of each of the most downstream slot 111, in the direction of the chord length, to ensure that for each of the most downstream slot of the plurality of slots, the connecting portions 112 has the surface 117, directed toward the working fluid flow passageway, positioned closer to the hollow region 113 than to the blade surface.

For example, for an existing stationary blade without any slot on its surface, as with the stationary blade 201 in the first comparative example, a plurality of slots may be formed on the blade surface by cutting the blade surface with a cutter-shaped member, a laser, or the like, and thereby a connecting portion at the most downstream slot may be formed to obtain substantially the same blade construction as that of the stationary blade 101 according to the present embodiment. In addition, for a stationary blade with a plurality of slots arranged at predetermined intervals on the blade surface, as with the stationary blade 301 in the second comparative example, the discontinuous portions between the most downstream slots may be cut off with a cutter-shaped member, a laser, or the like, and then a connecting portion may be disposed to obtain substantially the same blade construction as that of the stationary blade 101 according to the present embodiment.

In this way, the stationary blade 101 according to the present embodiment can be easily obtained just by performing simple operations upon an existing stationary blade.

Second Embodiment

Figure 12:
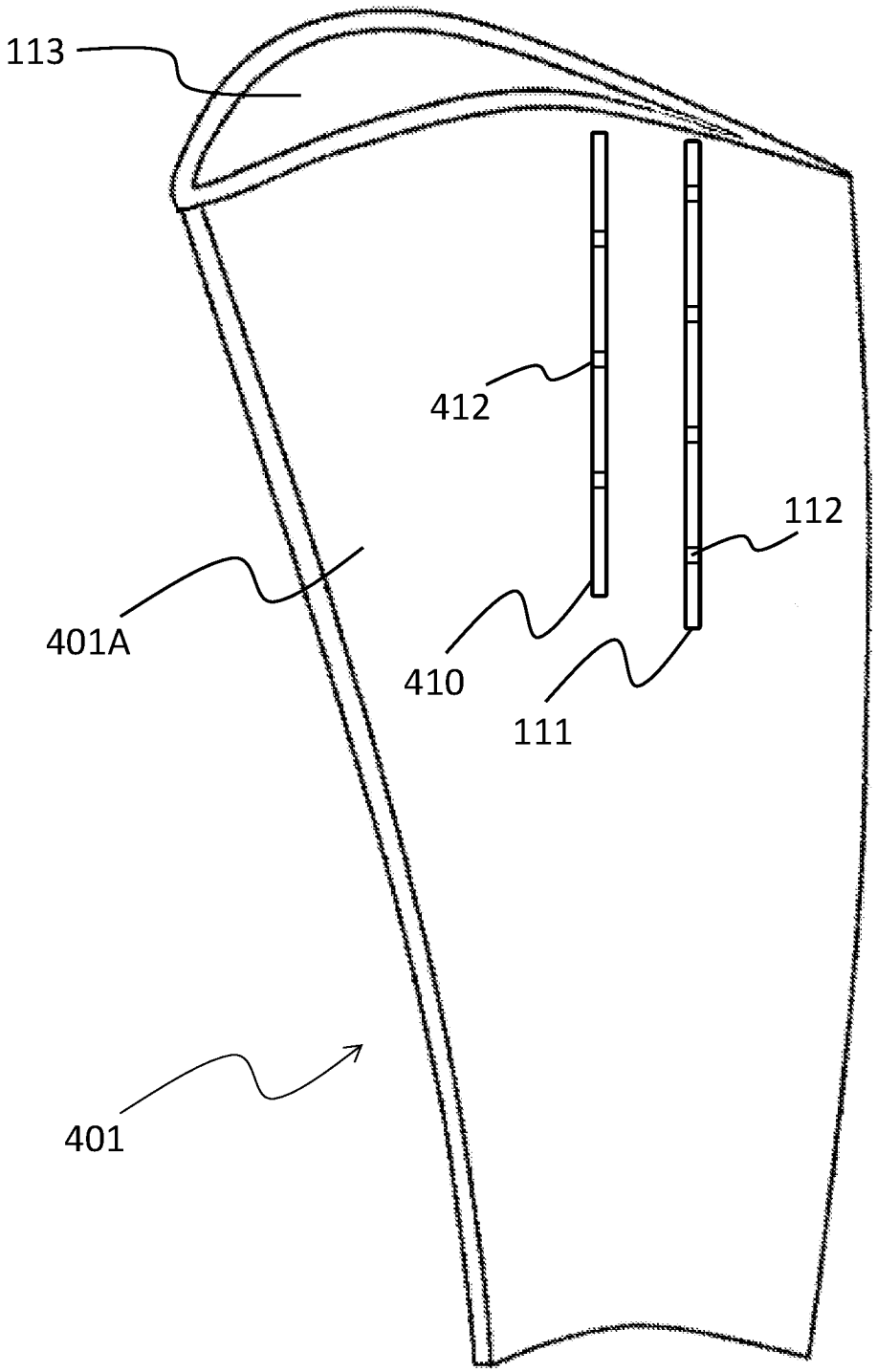
FIG. 12 is a perspective view of a stationary blade according to a second embodiment of the present invention.

FIG. 12 is a perspective view of a stationary blade according to a present embodiment. In FIG. 12, elements equivalent to those of the stationary blade 101 in the first embodiment are each assigned the same reference number, and description of these elements is omitted as appropriate.

As shown in FIG. 12, the stationary blade 401 according to the present embodiment differs from the stationary blade 101 of the first embodiment in that the former includes upstream slot 410 and connecting portions 412, instead of the upstream slot 110.

The upstream slot 410 and the connecting portions 412 are or configurations equivalent to those of the most downstream slot. 111 and the connecting portions 112. The connecting portions 412, however, are each shifted in position in the direction of the blade length relative to the connecting portions 112 of the most downstream slot 111.

With the above configuration, in addition to the advantageous effects obtained in the first embodiment, the following effects can be obtained in the present (second) embodiment.

In the present embodiment, the upstream slot 410 are continuously disposed on a pressure side of the airfoil 401A and at least one connecting portion 412 is disposed in the upstream slot 410, so that this configuration allows capture of much more liquid film than in an upstream slot configuration obtained by arranging a plurality of upstream slots at predetermined intervals in the direction of the blade length.

Third Embodiment

Figure 13:
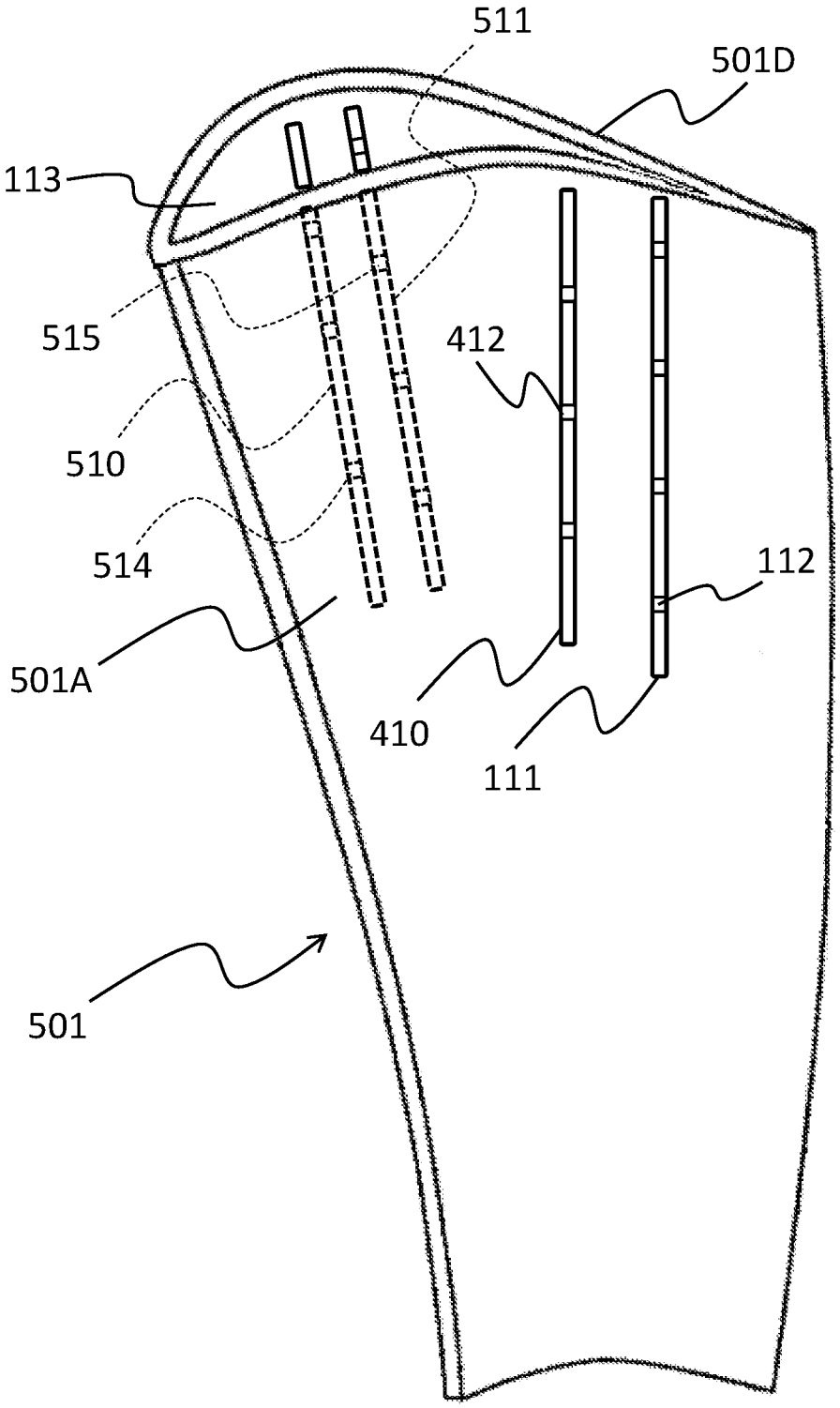
FIG. 13 is a perspective view of a stationary blade according to a third embodiment of the present invention.

FIG. 13 is a perspective view of a stationary blade according to a present embodiment. In FIG. 13, elements equivalent to those of the stationary blade 401 in the second embodiment, are each assigned the same reference number, and description of these elements is omitted as appropriate.

As shown in FIG. 13, the stationary blade 501 according to the present embodiment differs from the stationary blade 401 of the second embodiment in that the former includes not only upstream slots 510 and connecting portions 514, but also most downstream slots 511 and connecting portions 515, on a suction side of the airfoil 501D as well as pressure side of the airfoil 501A.

The upstream slot 510 and the connecting portions 514 are of configurations equivalent to those of the upstream slot 410 and the connecting portions 412, and the most downstream slots 511 and the connecting portions 515 are of configurations equivalent to those of the most downstream slot its and the connecting portions 112.

With the above configuration, in addition to the advantageous effects obtained in the second embodiment, the following effects can be obtained in the present (third) embodiment.

In the present embodiment, a liquid film formed on the suction side of the airfoil 501D can also be captured since not only the upstream slot 510 and the connecting portions 514, but also the most downstream slot 511 and the connecting portions 515 are arranged on the suction side of the airfoil 501D as well as pressure side of the airfoil 501A.

Fourth Embodiment

Figure 14:
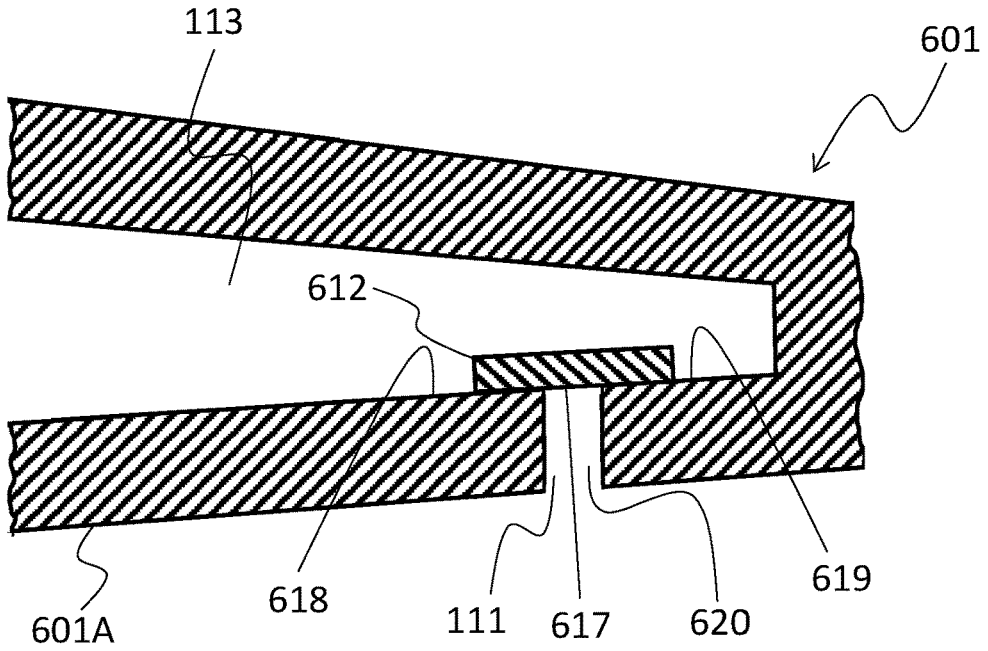
FIG. 14 is a cross-sectional view of a stationary blade according to a fourth embodiment of the present invention.

FIG. 14 is a cross-sectional view of a stationary blade according to a present embodiment. In FIG. 14, elements equivalent to those of the stationary blade 101 in the first embodiment are each assigned the same reference number, and description of these elements is omitted as appropriate.

The stationary blade 601 according to the present embodiment differs from the stationary blade 101 of the first embodiment in that the former includes connecting portions 612, instead of the connecting portions 112. Other configurational aspects are substantially the same as those of the first embodiment.

As shown in FIG. 14, each of the connecting portions 612 is provided inside a hollow region 113 so that for each of the most downstream slot 111, a surface 617 directed toward a working fluid flow passageway is positioned closer to the hollow region 113 than to a pressure side of the airfoil 601A. Each connecting portion 612 connects both sidewall surfaces 618 and 619 of the most downstream slot 111, in a direction of a chord length, across each of the most downstream slot 111. In other words, at a section shown in FIG. 14, a dent 620 which is indented toward the hollow region 113 from the pressure side of the airfoil. 601A, and whose bottom forms the surface 617 directed toward the working fluid flow passageway is formed on the pressure side of the airfoil 601A so as to appropriately fit the most downstream slot 111. Both end portions of the connecting portion 612, in the direction of the blade length, communicate with the hollow region 113 via the most downstream slot 111. The connecting portion 612 is mounted across the sidewall surfaces 618 and 619 by welding, for example.

A liquid film that has flown into the dent 620 from the pressure side of the airfoil 601A flows in the direction of the blade length, along the surface 617 directed toward the working fluid flow passageway, and the liquid film is next drawn into the hollow region 113 via the most downstream slot 111 and supplied to an exhaust chamber and the like.

With the above configuration, in addition to the advantageous effects obtained in the first embodiment, the following effects can be obtained in the present (fourth) embodiment.

When a connecting portion connects opposed inner walls of the most downstream slot, in a direction of the chord length, height of the connecting portion in a depth direction of a dent is limited to obtain appropriate depth of the dent. By contrast, in the present embodiment, since the connecting portion 612 is disposed inside the hollow region 113, height of the connecting portion, in a depth direction of the dent 620, can be made large, which in turn further enhances strength of the stationary blade 601. In addition, compared with disposing the connecting portion inside slot, the above disposition allows depth from the pressure side of the airfoil 601A to the surface 617 directed toward the working fluid flow passageway to be rendered larger (i.e., to be increased according to particular plate thickness of the pressure side of the airfoil 601A), which in turn enables the liquid film to be captured more efficiently.

Furthermore, the stationary blade 601 according to the present embodiment can be easily manufactured since the most downstream slot 111 can be provided on the pressure side of the airfoil 601A and the connecting portion 612 since can be provided inside the hollow region 113 by, for example, welding so that both sidewall surfaces 118 and 119 of the stationary blade 601, in the direction of the chord length, are connected across the most downstream slot 111.

Fifth Embodiment

Figure 15:
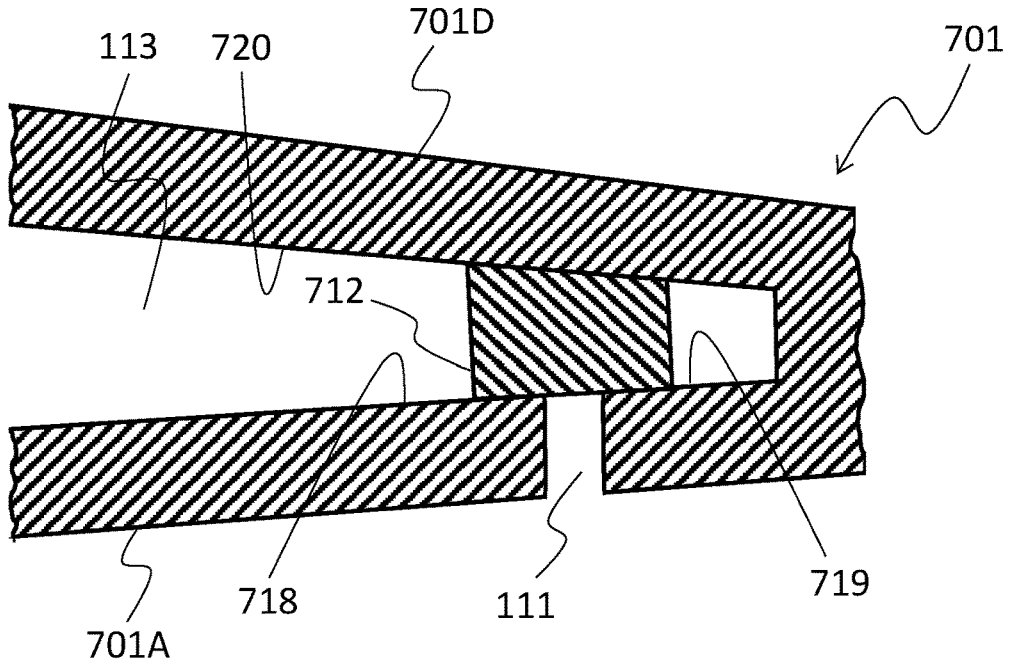
FIG. 15 is a cross-sectional view of a stationary blade according to a fifth embodiment of the present invention.

FIG. 15 is a cross-sectional view of a stationary blade according to a present embodiment. In FIG. 15, elements equivalent to those of the stationary blade in the fourth embodiment are each assigned the same reference number, and description of these elements is omitted as appropriate.

The stationary blade 701 according to the present embodiment differs from the stationary blade 601 of the fourth embodiment in that the former includes connecting portions 712, instead of the connecting portions 612. Other configurational aspects are substantially the same as those of the fourth embodiment.

The connecting portions 712 are each in contact with a surface opposes to one of the most downstream slot 111 across a hollow region 113, that is a suction side of the airfoil 701D. Other configurational aspects are substantially the same as those of the connecting portions 612.

With the above configuration, in addition to the advantageous effects obtained in the fourth embodiment, the following effects can be obtained in the present (fifth) embodiment.

In the present embodiment, since each connecting portion 712 is in contact with the suction side of the airfoil 701D, strength of the stationary blade 701 can be significantly enhanced. In addition, since the connecting portion 712 functions as a spacer to maintain a space requirement between a pressure side of the airfoil 701A and suction side of the airfoil 701D, deformation and the like of the stationary blade 701 can be suppressed and reliability of the stationary blade 701 can be enhanced.

Others

The present invention is not limited to the embodiments described above, and it encompasses various modifications. For example, the above embodiments have been described in detail for a better understanding of the invention, and each of the embodiments is not always limited to those including all the described elements. In addition, part of the configuration of an embodiment may be replaced with the configuration of another embodiment, and part of the configuration of an embodiment may be deleted or may be replaced with part of another embodiment's.

In the above embodiments, an example in which the connecting portions corresponding to the most downstream slot are arranged inside a hollow region has been described. A substantive effect of the present invention is to provide a steam turbine stationary blade adapted to remove the liquid film effectively, and as far as this substantive effect can be obtained, the invention is not always limited to the configuration. For example, connecting portions corresponding to the most downstream slot, and connecting portions corresponding to the upstream slot may be arranged inside a hollow region.

DESCRIPTION OF REFERENCE NUMBERS

113: Hollow region
104: Steam turbine moving blade (Moving blade)
101, 401, 501, 601, 701: Steam turbine stationary blades (Stationary blades)
110, 410, 510: Slot (Upstream slot)
111, 511: Slot (Most downstream slot)
112, 412, 514, 515, 612, 712: Connecting portions
101A, 401A, 501A, 601A, 701A: Pressure sides of airfoil
501D: Suction side of airfoil
101C: Leading edge
101B: Trailing edge

What is claimed is:

1. A steam turbine stationary blade with a hollow region therein, the steam turbine stationary blade comprising:

a plurality of slots arranged in lines in a direction of a chord length, the plurality of slots each communicates with a working fluid flow passageway and with the hollow region, and extends in a direction of a blade length; and at least one connecting portion disposed so that for each of the most downstream slot of the plurality of slots, a surface directed toward the working fluid flow passageway is positioned closer to the hollow region than to a surface of the steam turbine stationary blade, and so that the connecting portion connects both sidewall surfaces of each of the most downstream slot, in the direction of the chord length, wherein the plurality of slots communicate the working fluid flow passageway and the hollow region over an entire length thereof in the blade length direction, the connecting portion connects both sidewall surfaces of the most downstream slot, with only a part of the most downstream slot in the blade length direction.

2. The steam turbine stationary blade according to claim 1, wherein:

the connecting portion is disposed inside each of the most downstream slots and connects inner surfaces of the most downstream slot that face each other, in the direction of the chord length.

3. The steam turbine stationary blade according to claim 1, comprising:

at least one connecting portion positioned so that a surface directed toward the working fluid flow passageway is positioned closer to the hollow region than to the surface of the steam turbine stationary blade, for at least one upstream slot disposed upstream in the direction of the chord length with respect to the most downstream slots, the connecting portion connecting both sidewall surfaces of the upstream slot, in the direction of the chord length.

4. The steam turbine stationary blade according to claim 3, wherein:

the plurality of slots are provided on a pressure side of the airfoil.

5. The steam turbine stationary blade according to claim 4, wherein:

the upstream slot is provided at a position falling within a 0.6 to 0.8 range of a dimensionless value l/L obtained by dividing a distance l as measured from a leading edge portion to a given position on the pressure side of the airfoil, by a distance L as measured from the leading edge portion to a trailing edge portion, along the pressure side of the airfoil; and the most downstream slots are positioned so that they fall within a range exceeding the dimensionless value l/L of the upstream slot.

6. The steam turbine stationary blade according to claim 1, wherein:

the plurality of slots are provided on a suction side of the airfoil.

7. The steam turbine stationary blade according to claim 1, wherein:

the connecting portion is disposed inside the hollow region and connects both sidewall surfaces of the most downstream slot in the direction of the chord length, across the most downstream slot.

8. A steam turbine with a turbine stage, the steam turbine including:

the steam turbine stationary blade of claim 1; and a steam turbine moving blade provided downstream of a direction in which a working fluid flows, relative to the steam turbine stationary blade.

9. A steam turbine stationary blade with a hollow region therein, the steam turbine stationary blade comprising:

a plurality of slots arranged in lines in a direction of a chord length, the plurality of slots each communicates with a working fluid flow passageway and with the hollow region, and extends in a direction of a blade length; and at least one connecting portion disposed so that for each of the most downstream slots of the plurality of slots, a surface directed toward the working fluid flow passageway is positioned closer to the hollow region than to a surface of the steam turbine stationary blade, and so that the connecting portion connects both sidewall surfaces of each of the most downstream slots, in the direction of the chord length, wherein:

the connecting portion is disposed inside the hollow region and connects both sidewall surfaces of each most downstream slot in the direction of the chord length, across the most downstream slot, and the connecting portion is in contact with a surface opposed to each of the most downstream slots, across the hollow region.

10. A method for modifying a steam turbine stationary blade including a hollow region inside the blade, the method comprising:

forming a plurality of slots arranged in lines in a direction of a chord length, each communicating with a working fluid flow passageway and the hollow region, the slots extending in a direction of a blade length; and providing at least one connecting portion that connects both sidewall surfaces of each of the most downstream slots, in the direction of the chord length, in such a form that for each of the most downstream slots of the plurality of slots, a surface directed toward the working fluid flow passageway is positioned closer to the hollow region than to a surface of the steam turbine stationary blade, wherein:

the connecting portion is disposed inside the hollow region and connects both sidewall surfaces of each of the most downstream slots in the direction of the chord length, across the most downstream slots, and the connecting portion is in contact with a surface opposed to each of the most downstream slots, across the hollow region.

* * * * *